US012765598B2

(12) United States Patent
Chen

(10) Patent No.: US 12,765,598 B2
(45) Date of Patent: Oct. 20, 2026

(54) HIGH STRENGTH ATOMIZATION ASSEMBLY AND ATOMIZATION APPARATUS

(71) Applicant: Shenzhen Huachengda Precision Industry Co., Ltd., Shenzhen (CN)

(72) Inventor: Ping Chen, Shenzhen (CN)

(73) Assignee: Shenzhen Huachengda Precision Industry Co., Ltd., Shenzhen (CN)

( * ) Notice: Subject to any disclaimer, the term of this patent is extended or adjusted under 35 U.S.C. 154(b) by 619 days.

(21) Appl. No.: 18/272,361

(22) PCT Filed: Jan. 20, 2021

(86) PCT No.: PCT/CN2021/072932

§ 371 (c)(1),
(2) Date: Jul. 14, 2023

(87) PCT Pub. No.: WO2022/155817

PCT Pub. Date: Jul. 28, 2022

(65) Prior Publication Data

US 2024/0306714 A1 Sep. 19, 2024

(51) Int. Cl.

| | |
|---|---|
| ***A24F 40/46*** | (2020.01) |
| ***A24F 40/10*** | (2020.01) |
| ***A24F 40/44*** | (2020.01) |

(52) U.S. Cl.

CPC ..... *A24F 40/46* (2020.01); *A24F 40/10* (2020.01); *A24F 40/44* (2020.01)

(58) Field of Classification Search

CPC ..... A24F 40/10; A24F 40/46; A24F 40/44
See application file for complete search history.

(56) References Cited

U.S. PATENT DOCUMENTS

2018/0317559 A1 11/2018 Qiu
2018/0360112 A1 12/2018 Qiu
(Continued)

FOREIGN PATENT DOCUMENTS

CN 108308715 A 7/2018
CN 109330028 A 2/2019
(Continued)

OTHER PUBLICATIONS

International Search Report of PCT Patent Application No. PCT/CN2021/072932 issued on Jul. 15, 2021.
(Continued)

*Primary Examiner* — Michael H. Wilson
*Assistant Examiner* — Stephanie Lynn Moore

(57) ABSTRACT

A high strength atomization assembly, which comprises a support housing, a heating body, a liquid guide body, and a cover body; the support housing is provided with a first opening and a second opening in communication with the first opening, at least part of the heating body is inset in the support housing and integrated with the support housing, and said heating body and the support housing define an accommodation compartment that opens from the first opening; the liquid guide body is arranged within the accommodation compartment; and the cover body is arranged at the first opening, so as to limit the liquid guide body inside the accommodation compartment. Further provided is an atomization apparatus comprising the atomization assembly. The support housing provides support to the heating body, and increases the strength of the heating body, causing the heating body to not be prone to deformation.

20 Claims, 11 Drawing Sheets

(56) References Cited

U.S. PATENT DOCUMENTS

| | | | | |
|---|---|---|---|---|
| 2019/0246692 | A1* | 8/2019 | Li | A24F 1/00 |
| 2020/0114094 | A1 | 4/2020 | Atkins et al. | |
| 2024/0306714 | A1* | 9/2024 | Chen | A24F 40/10 |

FOREIGN PATENT DOCUMENTS

| | | | |
|---|---|---|---|
| CN | 111772242 | A | 10/2020 |
| CN | 112137177 | A | 12/2020 |
| WO | 2018019477 | A1 | 2/2018 |

OTHER PUBLICATIONS

Extended European Search Report of Counterpart European Patent Application No. 21920220.7 issued on Jan. 19, 2024.

* cited by examiner

HIGH STRENGTH ATOMIZATION ASSEMBLY AND ATOMIZATION APPARATUS

FIELD

The present invention relates to the technical field of atomization, and more specifically, to a high strength atomization assembly and an atomization apparatus.

BACKGROUND

A traditional atomization assembly generally adopts a solid liquid guide medium such as a porous ceramics as a support body for a liquid guide body and a heating body, which has a good effect during the use and thus is widely used. However, due to the complex production process, high requirement for the production equipment, high temperature for firing and molding, complex manufacturing process and long manufacturing period, of such porous ceramics, mass production is not facilitated, and the dimensional accuracy is poor. Due to that high-temperature and long-term firing is needed, the energy waste in the manufacturing process is large, and the heating body material will be seriously oxidized in the high-temperature firing process, which has a great impact on the service life of the heating material.

SUMMARY

Technical Problems

A technical problem to be solved by the present invention is, in view of the aforementioned defects in the prior art, to provide a high strength atomization assembly and an atomization apparatus.

Solutions of Problems

Technical Solutions

A technical solution adopted by the present invention to solve the technical problem includes, to provide a high strength atomization assembly, including:

- a support housing including a first side and a second side, wherein the first side is provided with a first opening, and the second side is provided with a second opening in communication with the first opening;
- a heating body provided at the second opening of the support housing, wherein at least part of the heating body is inset in the support housing and combined with the support housing, and the heating body and the support housing define an accommodation compartment open from the first opening;
- a liquid guide body arranged in the accommodation compartment; and
- a cover body provided at the first opening to limit the liquid guide body in the accommodation compartment.

Preferably, the liquid guide body is soft.

Preferably, the cover body is provided with a liquid inlet hole in communication with the liquid guide body.

Preferably, the cover body is inserted into the first opening.

Preferably, the cover body is tightly fitted with an inner wall of the first opening.

Preferably, an inner side of the first opening is provided with a first step for positioning the cover body, and the cover body is abutted against the first step.

Preferably, an outer side of the support housing is provided with a second step facing the second side.

Preferably, at least part of the heating body is inset in the support housing at the second side of the support housing.

Preferably, the heating body includes a heating portion, at least one electrode portion and at least one connecting portion, the heating portion is connected with the at least one electrode portion, the at least one connecting portion is arranged on an at least one edge of the heating portion and/or the at least one electrode portion; the at least one connecting portion is embedded in the support housing, and the position of the heating portion corresponds to the second opening.

Preferably, the at least one electrode portion is embedded in the support housing.

Preferably, the at least one electrode portion includes at least two electrode portions, and the heating portion is connected with the at least two electrode portions to form a heating circuit.

Preferably, the heating portion includes at least one heating strip.

Preferably, a sectional dimension of each of the at least one heating strip is smaller than a sectional dimension of the electrode portion.

Preferably, the at least one heating strip is curved or bent.

Preferably, the at least one connecting portion includes at least two connecting portions.

Preferably, each of the at least one connecting portion includes a first portion extending from the heating portion and/or the at least one electrode portion and a second portion connected with the first portion; and a size of the second portion is larger than a size of the first portion in a direction not parallel to the extending direction of the first portion.

Preferably, the heating body is in a sheet shape, and the at least one connecting portion is bent in a thickness direction of the heating body.

Preferably, the at least one connection portion does not form a heating circuit with the heating portion and the at least one electrode portion.

Preferably, the heating body is integrally formed.

Preferably, the at least one electrode portion protrudes out of the support housing.

A technical solution adopted by the present invention to solve the technical problem includes, to provide an atomization apparatus, including a shell and the atomization assembly connected with the shell, wherein a liquid storage compartment in communication with the first opening of the atomization assembly is provided in the shell.

Beneficial Effects of the Invention

Beneficial Effects

The implementation of the technical solution in the present invention provides at least the following beneficial effects: the support housing of the high strength atomization assembly provides support to the heating body, thereby greatly improving the strength of the heating body, making the heating body not easily deformed; while the liquid guide body does not play a supporting role, therefore its material selection can be wider; the support housing, the heating body and the cover body can well limit the liquid guide body in the accommodation compartment, so that the liquid guide body can be fully contacted with the heating body.

BRIEF DESCRIPTION OF THE DRAWINGS

Description of the Drawings

Figure 1:
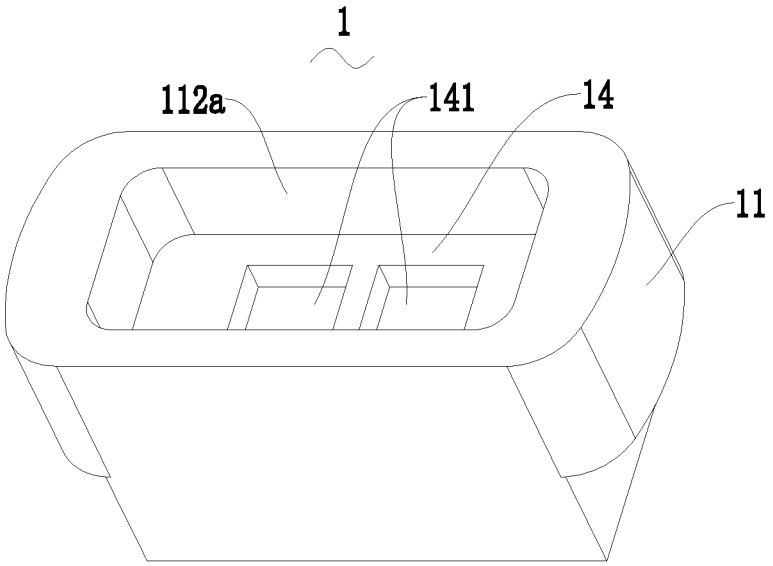

Subject matter of the present invention will be described in even greater detail below based on the exemplary figures. In the accompanying drawings:

FIG. 1 is a perspective view of an atomization assembly in a first embodiment of the present invention.

Figure 2:
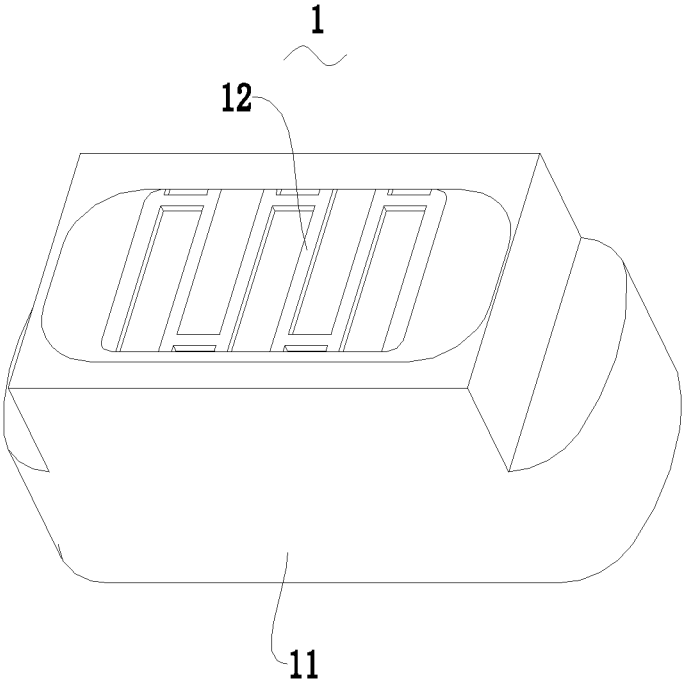

FIG. 2 is a perspective view, from another perspective, of the atomization assembly in FIG. 1.

Figure 3:
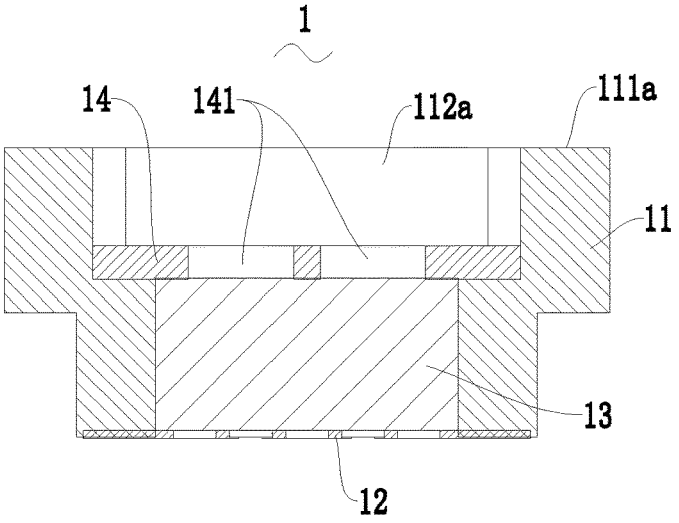

FIG. 3 is a sectional view of the atomization assembly in FIG. 1.

Figure 4:
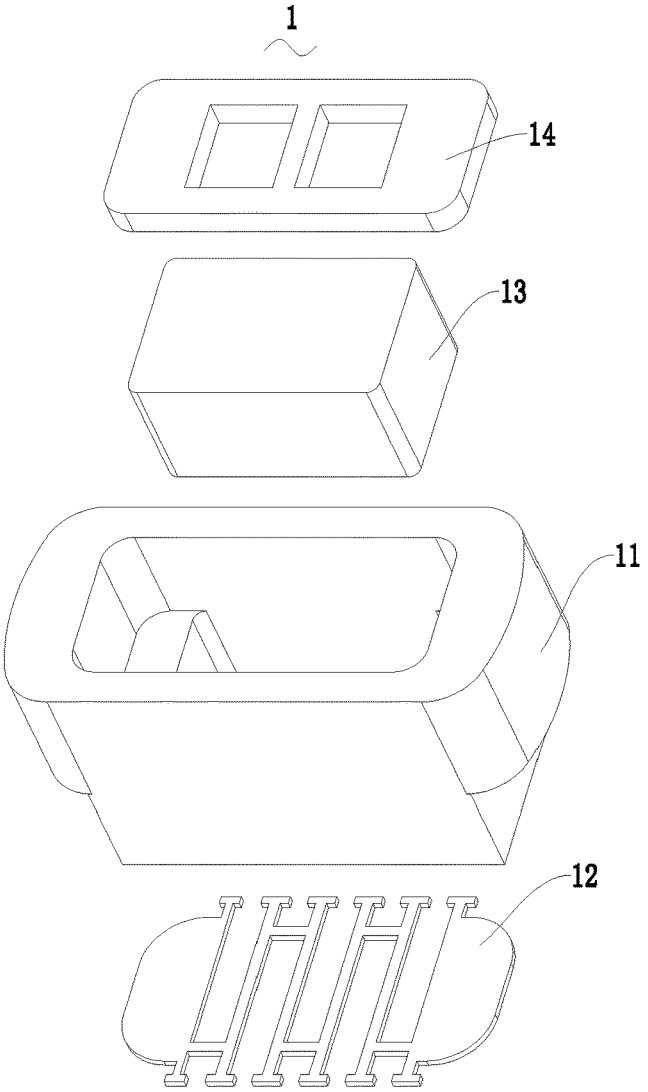

FIG. 4 is an exploded view of the atomization assembly in FIG. 1.

Figure 5:
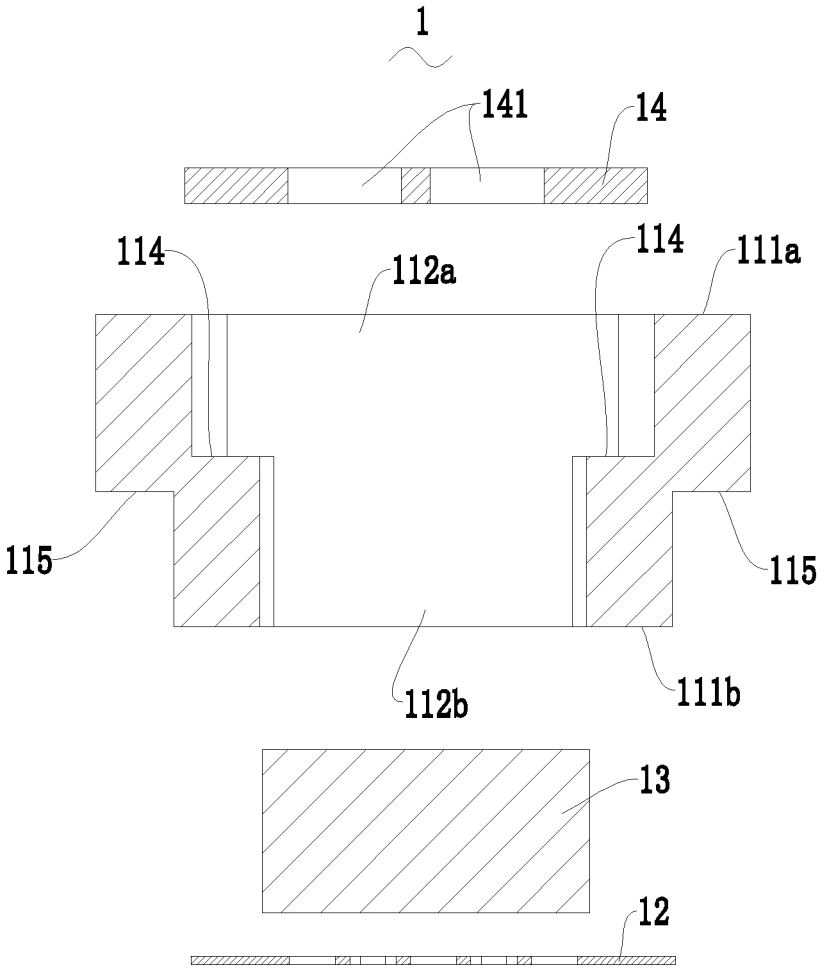

FIG. 5 is a sectional view of the atomization assembly in FIG. 1 in an exploded state.

Figure 6:
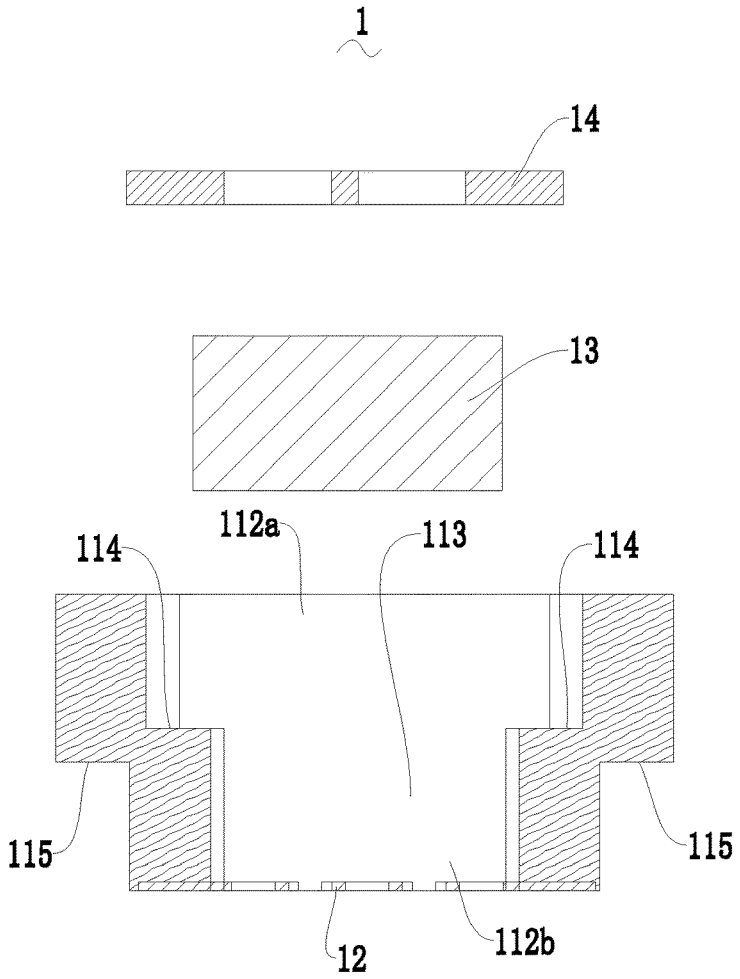

FIG. 6 is a sectional view of the atomization assembly in FIG. 1 in another exploded state.

Figure 7:
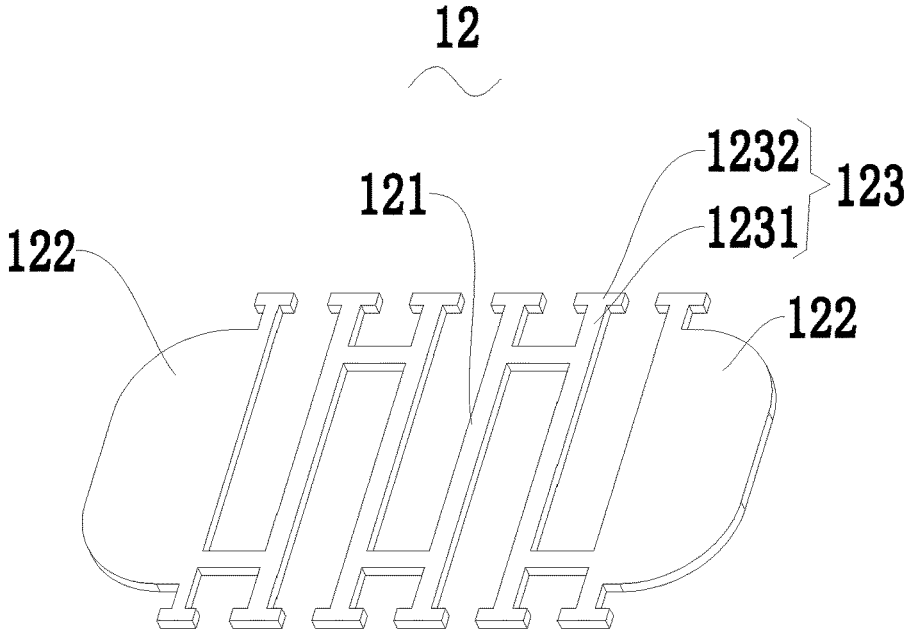

FIG. 7 is a perspective view of a heating body in FIG. 1.

Figure 8:
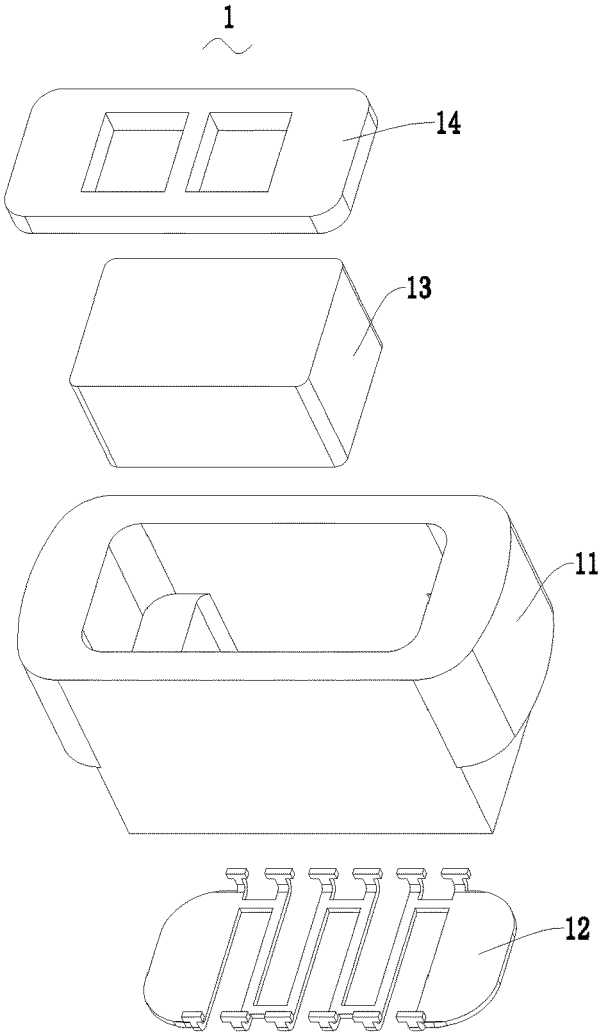

FIG. 8 is an exploded view of an atomization assembly in a second embodiment of the present invention.

Figure 9:
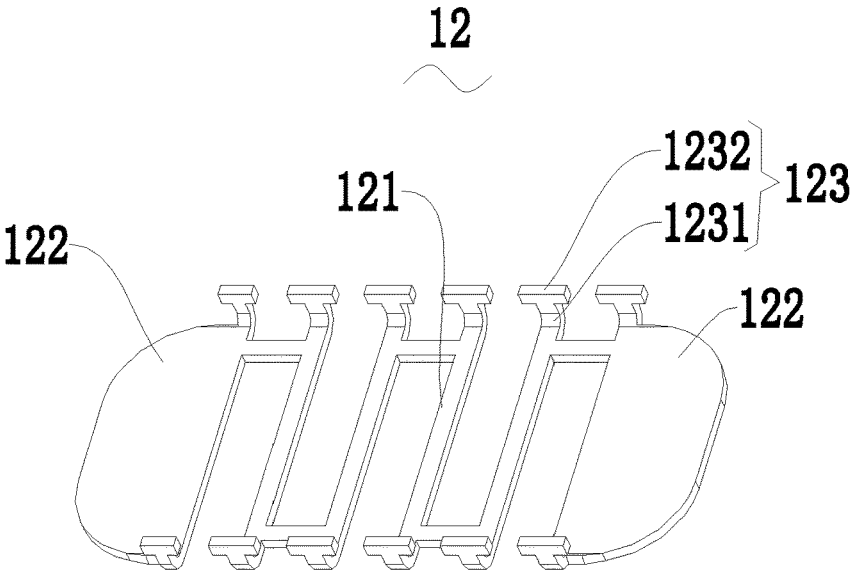

FIG. 9 is a perspective view of the heating body in FIG. 8.

Figure 10:
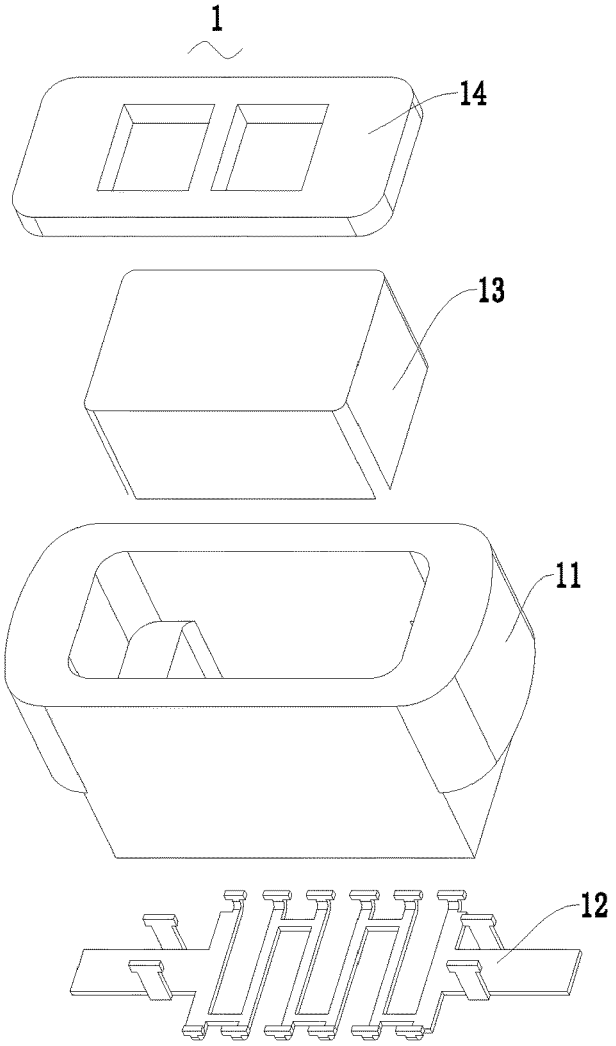

FIG. 10 is an exploded view of an atomization assembly in a third embodiment of the present invention.

Figure 11:
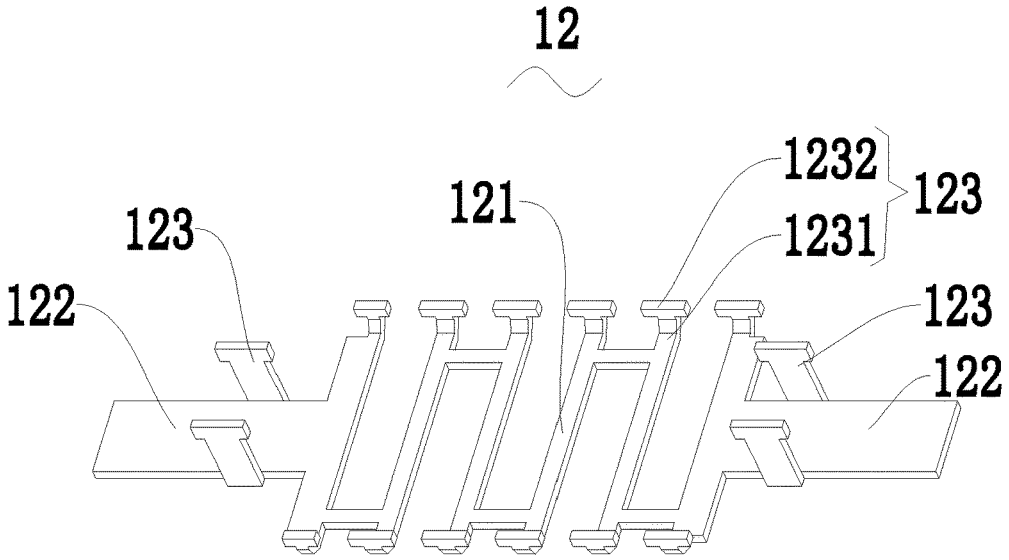

FIG. 11 is a perspective view of the heating body in FIG. 10.

Figure 12:
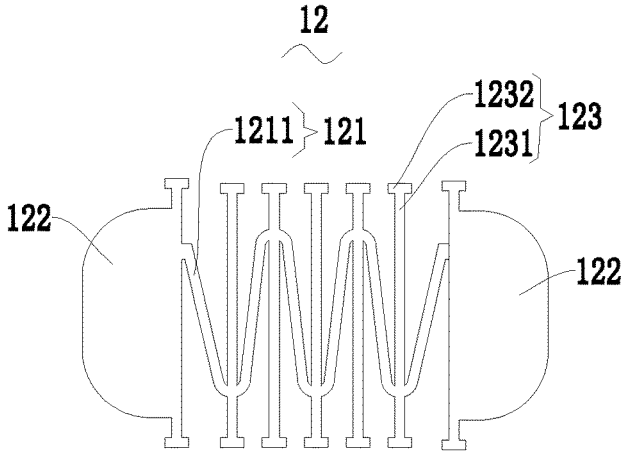

FIG. 12 is an orthographic view of a heating body in a fourth embodiment of the present invention.

Figure 13:
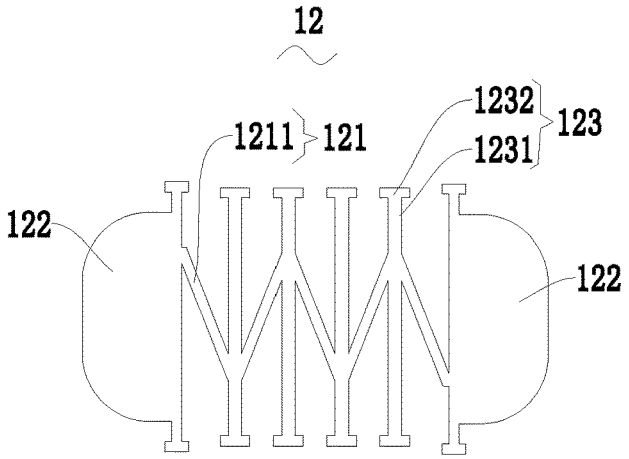

FIG. 13 is an orthographic view of a heating body in a fifth embodiment of the present invention.

Figure 14:
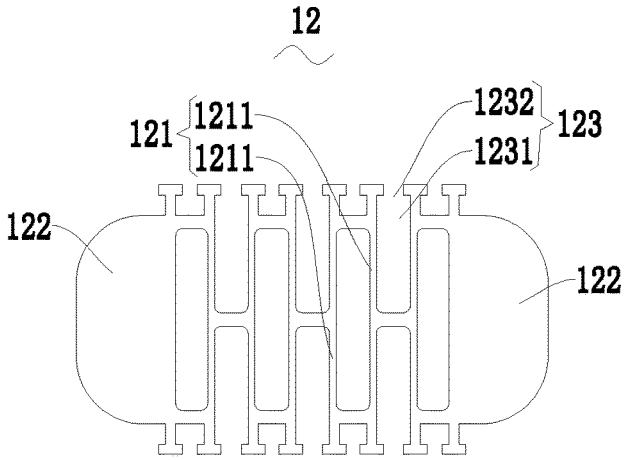

FIG. 14 is an orthographic view of a heating body in a sixth embodiment of the present invention.

Figure 15:
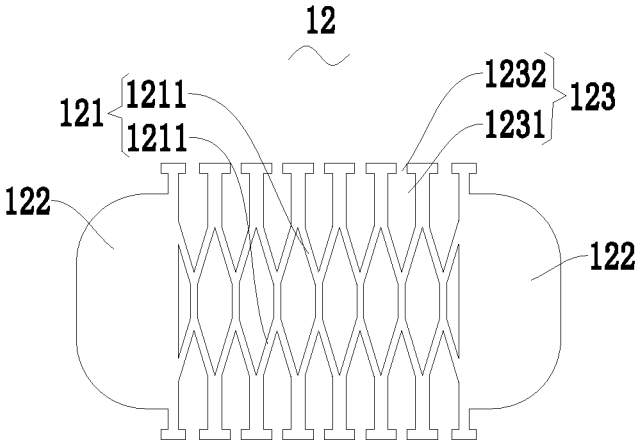

FIG. 15 is an orthographic view of a heating body in a seventh embodiment of the present invention.

Figure 16:
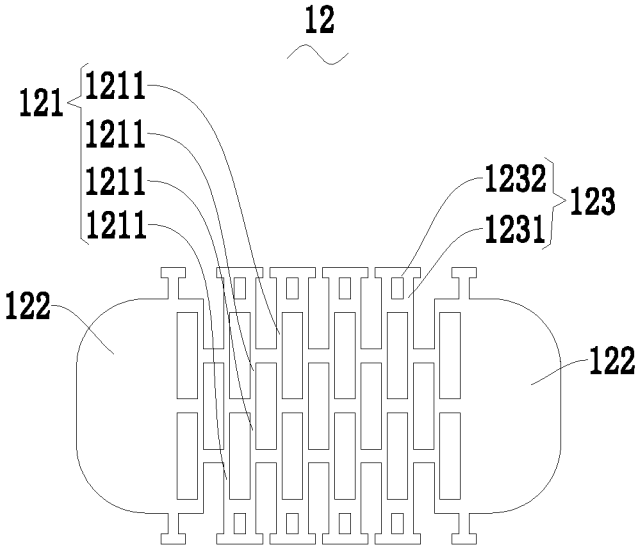

FIG. 16 is an orthographic view of a heating body in an eighth embodiment of the present invention.

Figure 17:
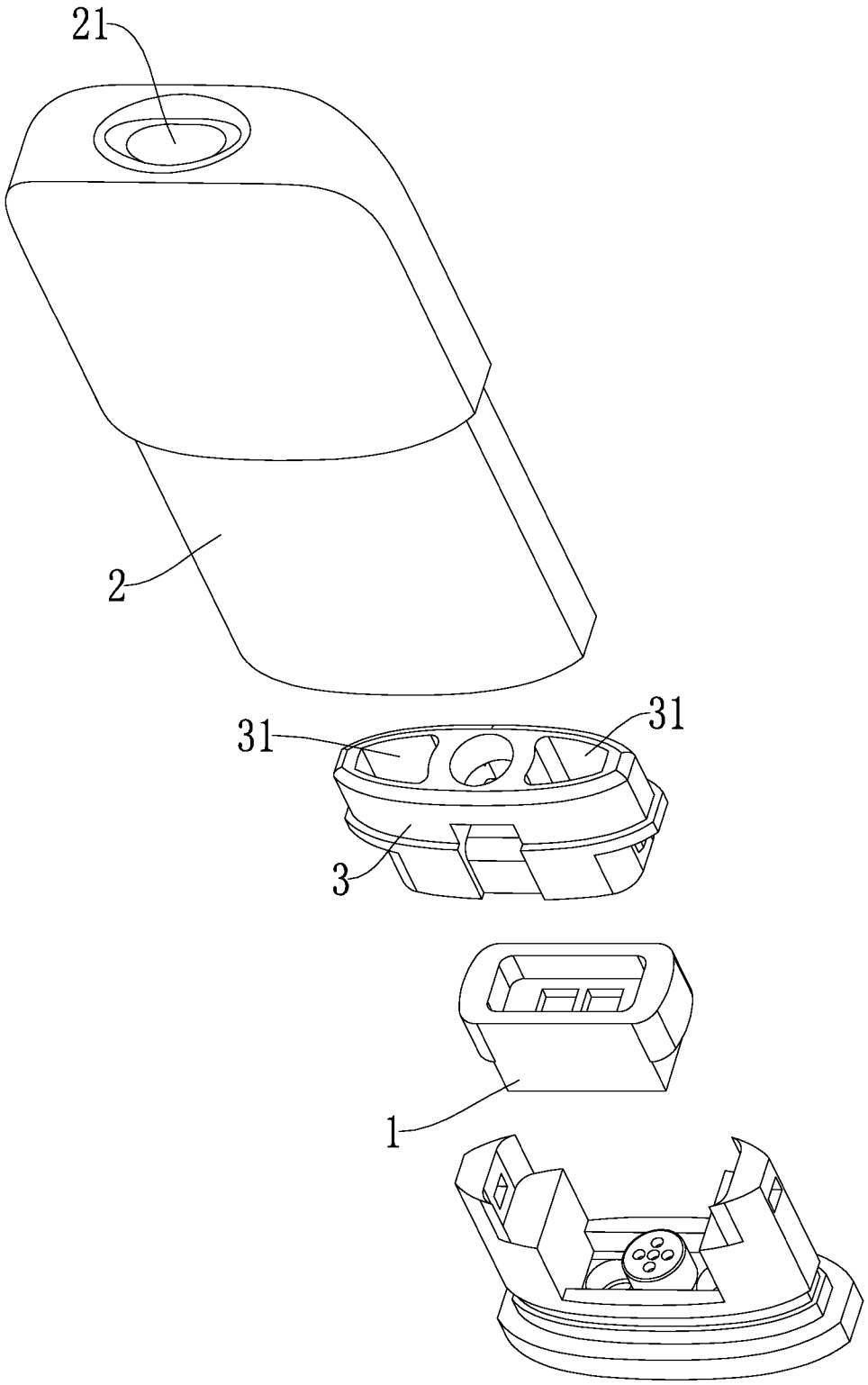

FIG. 17 is an exploded view of an atomization apparatus in an embodiment of the present invention.

Figure 18:
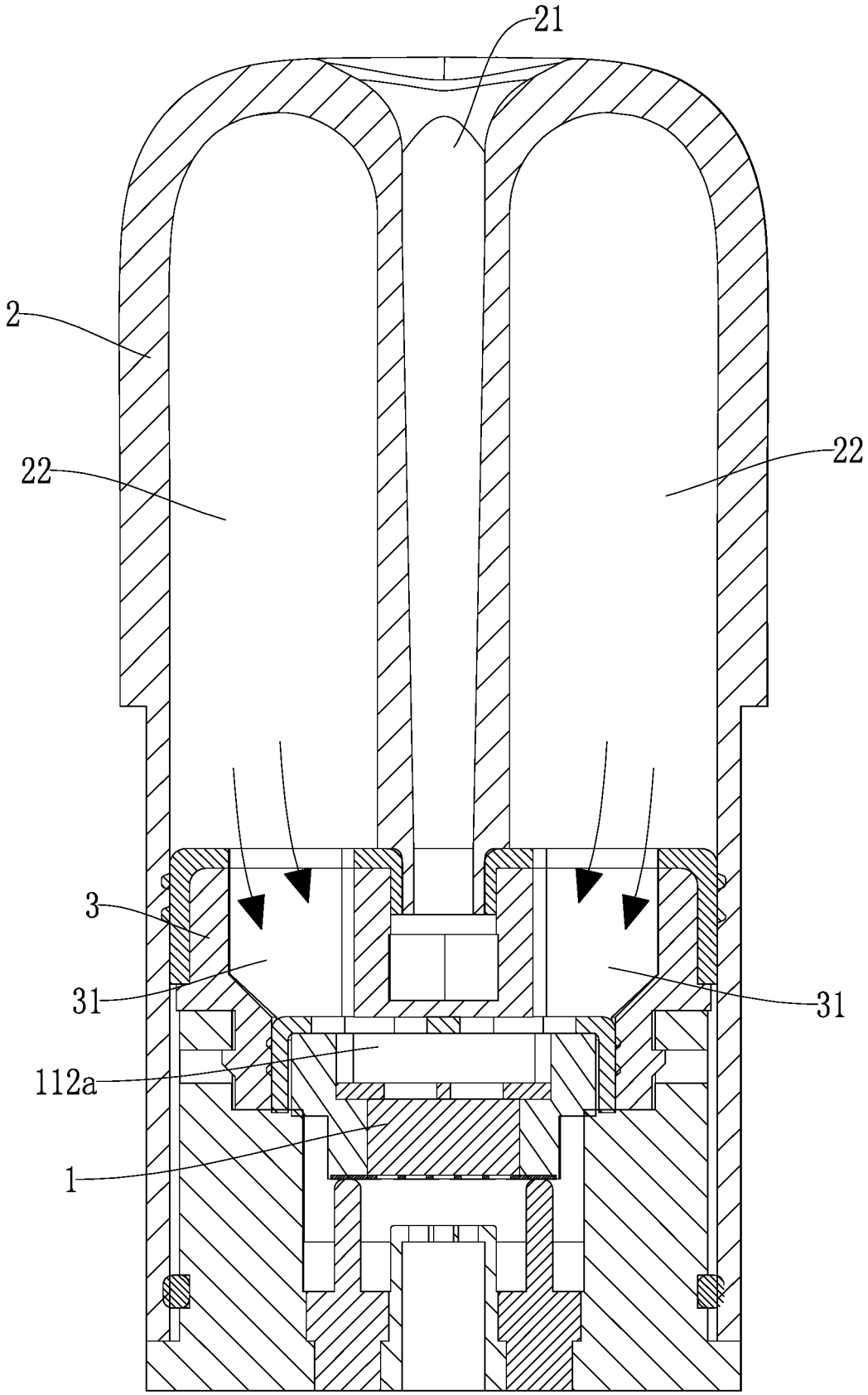

FIG. 18 is a sectional view of the atomization apparatus in FIG. 17 (wherein the arrows indicate the liquid flow direction).

Figure 19:
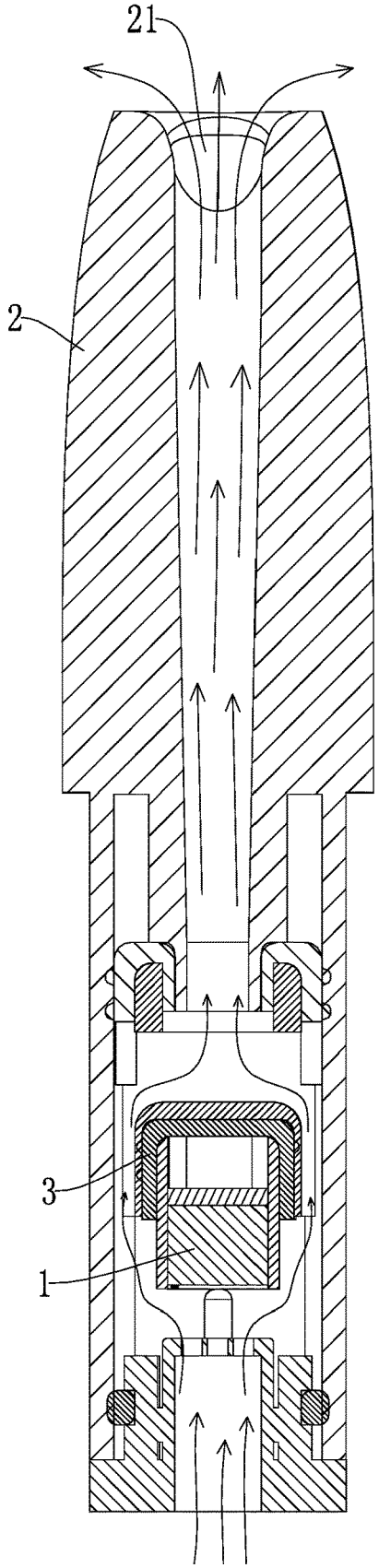

FIG. 19 is a sectional view, in another direction, of the atomization apparatus in FIG. 17 (wherein the arrows indicate the gas flow direction).

Wherein, the reference numerals in the figures represent: atomization assembly 1, supporting housing 11, first side 111*a*, first opening 112*a*, second side 111*b*, second opening 112*b*, accommodation compartment 113, first step 114, second step 115, heating body 12, heating portion 121, heating strip 1211, electrode portion 122, connecting portion 123, first portion 1231, second portion 1232, liquid guide body 13, cover body 14, liquid inlet hole 141, shell 2, air outlet hole 21, liquid storage compartment 22, upper seat 3, liquid channel 31.

DETAILED DESCRIPTION

Description of the Invention

For better understanding of the technical features, objects and effects of the present invention, the specific embodiments of the present invention will be described in detail with reference to the accompanying drawings. It should be understood that the orientation or the position relationship indicated by relative terms such as "front", "back", "upper", "lower", "left", "right", "longitudinal", "lateral", "vertical", "horizontal", "top", "bottom", "inner", "outer", "head", "tail" and the like are based on the directions or location relationships shown in the accompanying drawings, or the directions or location relationships that are usually placed or operated when the product is used, and are merely used for the convenience of describing the present invention, but are not used to indicate or imply that the referred apparatus or element needs to be constructed or operated in a particular orientation, and therefore, cannot be understood as a limitation to the present invention. It should be further noted that, in the present invention, unless specified or limited otherwise, the terms "mounted". "connected", "coupled", "fixed", "arranged" and the like should be understood in a broad sense, for example, the connection may be a fixed connection, a detachable connection, or an integral connection; or the connection may be a direct connection, or an indirect connection through an intermediary, or the connection may be an internal communication between two elements or a mutual action relationship between two elements, unless otherwise specified explicitly. When one element is described to be located "above" another element, it means that the element may be "directly" or "indirectly" located above another element, or there may be one or more intervening element located therebetween. The terms "first", "second", "third" and the like are only used for the convenience of describing the technical solution, and cannot be understood as indicating or implying the relative importance or implicitly indicating the number of the indicated technical features. Therefore, features defined with "first", "second", "third", etc. may explicitly or implicitly indicates that one or more of these features may be included. For those of ordinary skill in the art, the specific meaning of the above-mentioned terms in the present invention can be understood according to specific circumstances.

In the description hereinbelow, for purposes of explanation rather than limitation, specific details such as specific systematic architectures and techniques are set forth in order to provide a thorough understanding of the embodiments of the present invention. However, it will be apparent to persons skilled in the art that the present invention may also be implemented in absence of such specific details in other embodiments. In other instances, detailed descriptions of well-known systems, devices, circuits, and methods are omitted so as not to obscure the description of the present invention with unnecessary detail.

As shown in FIG. 1 to FIG. 16, a high strength atomization assembly 1 in an embodiment of the present invention includes:

- a support housing 11 including a first side 111*a* and a second side 111*b*, wherein the first side 111*a* is provided with a first opening 112*a*, the second side 111*b* is provided with a second opening 112*b*, and the first opening 112*a* is communicated with the second opening 112*b* to form a hollow shape;
- a heating body 12 disposed at the second opening 112*b* of the support housing 11, wherein at least part of the heating body 12 is embedded in the support housing 11, combined with the support housing 11, and defines an accommodation compartment 113, with the support housing 11, for accommodating a liquid guide body 13 and opened from the first opening 112*a;*
- a liquid guide body 13 that is arranged in the accommodation compartment 113 and preferably soft; and
- a cover body 14 provided at the first opening 112*a* to confine the liquid guide body 13 in the accommodation compartment 113.

The high strength atomization assembly 1 can be used for heating and atomizing, the liquid guide body 13 is in contact with the heating body 12, and is configured to be in contact with the liquid and transmit the liquid to the heating body 12 for heating and atomizing.

The support housing 11 of the high strength atomization assembly 1 provides a support to the heating body 12, which greatly improves the strength of the heating body 12, so that the heating body 12 is not easily deformed; while the liquid guide body 13 does not play a supporting role, so its material selection can be wider; the support housing 11, the heating body 12 and the cover body 14 can well confine the liquid guide body 13 in the accommodation compartment 113, so that the liquid guide body 13 is in fully contact with the heating body 12, and the atomization assembly has the advantages of good strength, reliability, ease of assembly and mass production.

Therefore, the atomization assembly 1 is especially suitable for the situation where the liquid guide body 13 is soft.

The cover body 14 is provided with at least one liquid inlet hole 141 communicating with the liquid guide body 13, for the liquid to contact the liquid guide body 13 through the first opening 112*a* and the liquid inlet. The cover body 14 is preferably in a plate shape. The cover body 14 is inserted into the first opening 112*a* and sinks relative to the first side 111*a*. The shape of the first opening 112*a* is adapted to the shape of the cover body 14, and the cover body 14 is tightly fitted with the inner wall of the first opening 112*a*.

The functions of the various parts of the atomization assembly 1 are:

1, The functions of the support housing 11 is to: (1) provide the overall assembling dimension of the atomization assembly 1; (2) support the heating body 12, so that the heating body 12 has the strength and is not easily deformed; (3) act as a container for the liquid guide body 13.

2, The functions of the liquid guide body 13 is to: (1) conduct the liquid and lock the liquid from leakage; (2) be in fully contact with the heating body 12, so that the liquid is conducted to the heating body to be heated and evaporated.

3, The functions of the heating body 12 is to: (1) generate heat when electrified, to heat and evaporated the liquid; (2) provide a supporting force, so that the liquid guide body 13, especially the soft liquid guide body 13, is bound in the support housing 11, and to be in full contact with the liquid guide body 13.

4, The functions of the cover body 14 is to: (1) press the liquid guide body 13, especially the soft liquid guide body 13, so that the volume of the soft liquid guide body 13 is fixed, and the liquid guide ability of the soft liquid guide body 13 is consistent; (2) be provided with the liquid inlet hole 141 on the cover body 14, which can control the liquid inlet amount, so that the liquid inlet amount and the liquid consumption amount can be balanced.

The inner side of the first opening 112*a* is provided with a first step 114 facing the first side 111*a* for positioning the cover body 14, and the lower side of the cover body 14 abuts against the first step 114.

The outer side of the support housing 11 is provided with a second step 115 facing the second side 111*b*. When the atomization assembly 1 is installed in medical treatment, intelligent household electrical appliances, consumer electronic products or other products, the second step 115 is used for positioning the atomization assembly 1.

At least part of the heating body 12 is embedded in the support housing 11 at the second side 111*b* of the support housing 11, and the lower side of the heating body 12 may be flush with the second side 111*b*, or may sink relative to the second side 111*b*.

The heating body 12 includes a heating portion 121, an electrode portion 122 and a connecting portion 123. The heating portion 121 is connected with the electrode portion 122, and the connecting portion 123 is arranged on an edge of the heating portion 121 and/or the electrode portion 122. The connecting portion 123 is embedded in the support housing 11, so that the heating body 12 has strength, and the position of the heating portion 121 corresponds to the second opening 112*b*. The electrode portion 122 is used to be connected to a lead wire and a battery, and the electrode portion 122 may also be embedded in the support housing 11, so as to realize the connection between the heating body 12 and the support housing 11. The number of the electrode portions 122 is at least two, and the heating portion 121 is connected to at least two electrode portions 122 to form a heating circuit, and heat is generated according to the heating effect of the resistance when the electrodes are energized.

The heating portion 121 includes at least one heating strip 1211, which reflects the heating track of the heating portion 121. The sectional dimension of each heating strip 1211 is smaller than that of the electrode portion 122. Since the electrode portion 122 and the heating strip 1211 are made of a same material, the resistance of the heating strip 1211 is much larger than that of the electrode portion 122. When the electrode portion 122 is connected to and electrified by a power supply, the electrode portion 122 and the heating strip 1211 form a loop with the power supply, and the heating strip 1211 generates heat.

The heating strip 1211 is curved or bent, to form a wave shape or a zigzag shape, and a grid shape may be formed when there are at least two heating strips 1211. The heating strip 1211 has many embodiments, for example, may be a single heating circuit (see FIG. 12 and FIG. 13), double heating circuits (see FIG. 14 and FIG. 15), a wave-shaped heating circuit (see FIG. 12), a zigzag heating circuit (see FIG. 13 and FIG. 15), multiple groups of zigzag or wave-shaped heating circuits may be realized, and a plurality of extremely thin heating strips 1211 may also form a heating net (see FIG. 16). Through this structure, the heating body 12, which was originally easily deformed and difficult to assemble and produce, can be mass produced, and has a good strength and a reliable performance.

The number of the connecting portions 123 is at least two, and a larger number of the connecting portions 123 can improve the firmness of the connection between the heating body 12 and the support housing 11.

Each connecting portion 123 includes a first portion 1231 extending from the heating portion 121 and/or the electrode portion 122 and a second portion 1232 connected with the first portion 1231. In the direction not parallel to (preferably perpendicular to) the extension direction of the first portion 1231, the size of the second portion 1232 is larger than that of the first portion 1231, so that the connection with the support housing 11 is more secure.

The atomization assembly 1 has the characteristics of being easy to produce, and its production method may be as follows:

1, a sheet-like heating body 12 is prepared, wherein a sheet-like metal (such as a nickel-chromium alloy, an iron-chromium-aluminum alloy, a stainless steel alloy, a nickel-based alloy, a titanium, a titanium alloy, etc.)

with a relatively high resistivity may be used, and may be cut, chemical etched, laser engraved or the like, to form the sheet-like heating body 12 having the following characteristics.

2, the sheet-like heating body 12 is integrally formed with the support housing 11 through an in-mold injection process, wherein the support housing 11 may be made of a high-temperature-resistant engineering plastic material such as LCP (Liquid Crystal Polymer), PEEK (Polyether Ether Ketone), Nylon, PI (Polyimide), PAI (Polyamide-Imide), PA66 (Polyadiohexylenediamine) or the like; the sheet-like heating body 12 is placed in a forming mold, the molten plastic is filled with the mold by injection molding, the support housing 11 is formed after the plastic is cooled, so that the support housing 11 and the heating body 12 are consolidated together to form the form where part of the heating body 12 is embedded in the support housing 11, then the support housing 11 and the heating body 12 are taken out of the mold, the heating body 12 and the support housing 11 define the accommodation compartment 113 open from the first opening 112*a*; the heating body 12 is supported by the support housing 11 and thus has a good strength, which is beneficial to mass production.

3, the soft liquid guide body 13 is placed into the accommodation compartment 113 of the support housing 11, and then the cover body 14 is covered. Since the second opening 112*b* of the support housing 11 is blocked by the sheet-like heating body 12, and the first opening 112*a* is squeezed by the cover body 14, the volume of the soft liquid guide body 13 in the accommodation compartment 113 is fixed, and its ability to absorb the liquid and lock the oil is stable. The cover body 14 is embedded in the first opening 112*a* and tightly fitted with the inner wall of the first opening 112*a*. The cover body 14 is provided with at least one liquid inlet hole 141, and the size of the liquid inlet hole 141 can control the amount of liquid entering the soft liquid guide body 13, so that the amount of liquid inflow can be adjusted according to different concentrations of the liquid and the size of the liquid inlet hole 141, so as to achieve the balance between the liquid supply and the liquid consumption.

The material of the soft liquid guide body 13 may be formed by stacking multiple layers of a fibrous liquid guide material such as a non-woven fabric, a long-staple cotton cloth, a linen fiber cloth or the like, and then is cut into a size and shape matched the first opening 112*a* of the support housing 11 through a cutter die. The cover body 14 may be formed by injection molding of a plastic or by stamping of a metal.

The atomization assembly 1 thus produced has the characteristics of good strength, high reliability, accurate size, and easy mass production. Moreover, the production material is easy to obtain, the cost is low, and the production process is simple and fast.

In the high strength atomization assembly 1, the heating body 12 with a relatively low strength is combined with the support housing 11 made of a temperature-resistant insulating material with a certain strength, the heating body 12 is provided with an ineffective-heating low-temperature area, and the low-temperature area of the heating body 12 is in contact with the insulating material, so that the heating body 12 has strength, and can be better in contact with the liquid guide body 13 when the soft liquid guide body 13 is used.

Referring to FIG. 8 and FIG. 9, the heating body 12 is in a sheet shape, and the connecting portion 123 may further be bent in the thickness direction of the heating body 12, so that the connecting portion 123 can be embedded in the supporting housing 11 more deeply.

The connecting portion 123 does not form a heating circuit with the heating portion 121 and the electrode portion 122. In other words, when the electrode portion 122 is energized by the power supply, the electrode portion 122, the heating portion 121 and the power supply form a loop, and the heating portion 121 generates heat according to the resistance heating effect, while the connecting portion 123 extending outward is not in the range of the loop and has no current flowing through and does not generate heat, but the heat from the heating circuit in the loop is conducted to the connecting portion 123, and therefore the temperature of the connecting portion 123 is relatively low.

Preferably, the entire heating body 12 is integrally formed.

Referring to FIG. 10 and FIG. 11, the electrode portion 122 protrudes out of the support housing 11, which can facilitate the welding of a lead wire on the electrode portion 122 or the direct contact between the electrode portion 122 and a battery contact.

The atomization assembly 1 of the present invention can be used for atomization of various liquids, for example, in an electronic cigarette to atomize the e-liquid.

Referring to FIG. 17 to FIG. 19, an atomization apparatus in an embodiment of the present invention includes a shell 2 and the above-mentioned atomization assembly 1 connected to the shell 2, and further includes an upper seat 3 arranged in the shell 2. A liquid channel 31 is provided in the upper seat 3, a liquid storage compartment 22 for storing the liquid is provided in the shell 2, and an air outlet hole 21 is provided on the shell 2. The first opening 112*a* of the support housing 11 of the atomization assembly 1 is sunk into a groove shape to form a liquid inlet groove. The liquid channel 31 of the upper seat 3 communicates the liquid storage compartment 22 with the first opening 112*a* of the atomization assembly 1. The liquid is in contact with the liquid guide body 13, and conducted to the heating body 12 via the liquid guide body 13, and then heated and atomized by the heating body 12 to generate aerosol, which exits through the air outlet hole 21. The liquid is stored in the liquid storage compartment 22, flows to the first opening 112*a* of the atomization assembly 1 through the liquid channel 31 of the upper seat 3 and enters the liquid inlet groove (see FIG. 18, wherein the arrows indicate the liquid flow direction), and then flows through the liquid inlet hole 141 on the cover body 14 of the atomization assembly 1 to the liquid guide body 13. Since the gaps in the liquid guide body 13 are small, the liquid will remain on the liquid guide body 13 and will not leak out. When the user inhales, the switch is activated, and the heating body 12 generates heat according the resistance thermal effect, to heat and vaporize the liquid on the liquid guide body 13 in contact with the heating body 12 to form a gas-liquid mixture, which is sucked out by the user through the air outlet hole 21 (see FIG. 19, wherein the arrows indicate the gas flow direction). The atomization apparatus 1 can be used as an electronic cigarette, the liquid storage compartment stores the e-liquid, and the atomization assembly heats and atomizes the e-liquid.

Since the atomization apparatus adopts the above-mentioned high strength atomization assembly 1, thereby having the characteristics of good strength, high reliability, accurate size, and easy mass automatic production. Moreover, the production material is easy to obtain, the cost is low, and the production process is simple and fast.

The above descriptions are only preferred embodiments of the present invention, and are not intended to limit the present invention. For those skilled in the art, the present invention may have various modifications, combinations and changes. Any modification, equivalent replacement, improvement, etc. made within the spirit and principle of the present invention shall be included within the scope of the claims of the present invention.

What is claimed is:

1. A atomization assembly (1), comprising:

a support housing (11) comprising a first side (111*a*) and a second side (111*b*), wherein the first side (111*a*) is provided with a first opening (112*a*), and the second side (111*b*) is provided with a second opening (112*b*) in communication with the first opening (112*a*);

a heating body (12) provided at the second opening (112*b*) of the support housing (11), wherein at least part of the heating body (12) is inset in the support housing (11) and combined with the support housing (11), and the heating body (12) and the support housing (11) define an accommodation compartment (113) open from the first opening (112*a*);

a liquid guide body (13) arranged in the accommodation compartment (113); and a cover body (14) provided at the first opening (112*a*) to limit the liquid guide body (13) in the accommodation compartment (113);

wherein the heating body (12) comprises a heating portion (121), at least one electrode portion (122) and at least one connecting portion (123), wherein the heating portion (121) is connected with the at least one electrode portion (122), wherein the at least one connecting portion (123) is arranged on at least one edge of the heating portion (121) and/or the at least one electrode portion (122);

the heating body (12) is in a sheet shape, and the at least one connecting portion (123) is bent and embedded in the supporting housing (11); and the at least one connection portion (123) does not form a heating circuit with the heating portion (121) and the at least one electrode portion (122).

2. The atomization assembly (1) of claim 1, wherein the liquid guide body (13) is fibrous.

3. The atomization assembly (1) of claim 1, wherein the cover body (14) is provided with a liquid inlet hole (141) in communication with the liquid guide body (13).

4. The atomization assembly (1) of claim 1, wherein the cover body (14) is inserted into the first opening (112*a*), and wherein an inner side of the first opening (112*a*) is provided with a first step (114), and the cover body (14) is abutted against the first step (114).

5. The atomization assembly (1) of claim 4, wherein the cover body (14) is tightly fitted with an inner wall of the first opening (112*a*).

6. The atomization assembly (1) of claim 1, wherein an outer side of the support housing (11) is provided with a second step (115) facing the second side (111*b*).

7. The atomization assembly (1) of claim 1, wherein at least part of the heating body (12) is inset in the support housing (11) at the second side (111*b*) of the support housing (11).

8. The atomization assembly (1) of claim 1, wherein the position of the heating portion (121) corresponds to the second opening (112*b*).

9. The atomization assembly (1) of claim 8, wherein the at least one electrode portion (122) is embedded in the support housing (11).

10. The atomization assembly (1) of claim 8, wherein the at least one electrode portion (122) comprises at least two electrode portions (122), and the heating portion (121) is connected with the at least two electrode portions (122) to form a heating circuit.

11. The atomization assembly (1) of claim 8, wherein the heating portion (121) includes at least one heating strip (1211).

12. The atomization assembly (1) of claim 11, wherein a sectional dimension of each of the at least one heating strip (1211) is smaller than a sectional dimension of the electrode portion (122).

13. The atomization assembly (1) of claim 11, wherein the at least one heating strip (1211) is curved or bent.

14. The atomization assembly (1) of claim 8, wherein the at least one connecting portion (123) comprises at least two connecting portions (123).

15. The atomization assembly (1) of claim 8, wherein each of the at least one connecting portion (123) comprises a first portion (1231) extending from the heating portion (121) and/or the at least one electrode portion (122) and a second portion (1232) connected with the first portion (1231), and wherein, in a direction not parallel to the extending direction of the first portion (1231), a size of the second portion (1232) is larger than a size of the first portion (1231).

16. The atomization assembly (1) of claim 8, wherein the at least one connecting portion (123) is bent in a thickness direction of the heating body (12).

17. The atomization assembly (1) of claim 8, wherein the heating body (12) is integrally formed.

18. The atomization assembly (1) of claim 8, wherein the at least one electrode portion (122) protrudes out of the support housing (11).

19. An atomization apparatus, comprising:

a shell (2); and the atomization assembly (1) of claim 1, wherein the atomization assembly (1) is connected with the shell (2), and wherein a liquid storage compartment (22) in communication with the first opening (112*a*) of the atomization assembly (1) is provided in the shell (2).

20. The atomization assembly (1) of claim 1, wherein the support housing (11) provides support to the sheet-like heating body (12) by the at least one embedded connecting portion (123); or/and, wherein the sheet-like heating body (12) is integrally formed with the support housing (11) through an in-mold injection process; or/and, wherein the heating body (12) is provided with an ineffective-heating low-temperature area, and the ineffective-heating low-temperature area is in contact with the insulating support housing (11), so that the heating body (12) has strength; or/and, wherein the at least one connecting portion (123) is configured as a low-temperature portion that does not generate heat.

* * * * *